US011976857B2

(12) United States Patent
Koike et al.

(10) Patent No.: US 11,976,857 B2
(45) Date of Patent: May 7, 2024

(54) REFRIGERATION CYCLE DEVICE

(71) Applicant: Mitsubishi Electric Corporation, Tokyo (JP)

(72) Inventors: Takanori Koike, Tokyo (JP); Naomichi Tamura, Tokyo (JP); Hiroyuki Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 440 days.

(21) Appl. No.: 17/440,273

(22) PCT Filed: May 29, 2019

(86) PCT No.: PCT/JP2019/021302
§ 371 (c)(1),
(2) Date: Sep. 17, 2021

(87) PCT Pub. No.: WO2020/240732
PCT Pub. Date: Dec. 3, 2020

(65) Prior Publication Data

US 2022/0011028 A1 Jan. 13, 2022

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01); *F25B 2600/2501* (2013.01)

(58) Field of Classification Search
CPC .. F25B 41/20; F25B 13/00; F25B 2600/2501; F24B 2400/04
See application file for complete search history.

(56) References Cited

U.S. PATENT DOCUMENTS

2002/0108384 A1 8/2002 Higashiyama
2019/0226691 A1 7/2019 Tokudi et al.
(Continued)

FOREIGN PATENT DOCUMENTS

GB 2580262 A 7/2020
JP 2000-179955 A 6/2000
(Continued)

OTHER PUBLICATIONS

Extended European Search Report dated May 13, 2022 issued in corresponding European Patent Application No. 19930598.8.
(Continued)

*Primary Examiner* — Travis Ruby
(74) *Attorney, Agent, or Firm* — POSZ LAW GROUP, PLC

(57) ABSTRACT

A refrigeration cycle device according to the present disclosure includes: a refrigerant circuit including a compressor, a heat-source-side heat exchanger, a first expansion device, and a load-side heat exchanger, refrigerant cycling through the compressor, the heat-source-side heat exchanger, the first expansion device, and the load-side heat exchanger; a plurality of controllers configured to control the refrigerant circuit; a bypass pipe branching from a high pressure pipe on a discharge side of the compressor and connected to a low pressure pipe on a suction side of the compressor; a second expansion device provided to the bypass pipe, and configured to adjust a flow rate of the refrigerant flowing through the bypass pipe; and a plurality of refrigerant coolers provided to the bypass pipe, and configured to cool the plurality of controllers by using the refrigerant the flow rate of which is adjusted by the second expansion device, each of the plurality of refrigerant coolers including a refrigerant cooling pipe and a plate, the refrigerant cooling pipe forming the
(Continued)

bypass pipe, the plate being joined between the refrigerant cooling pipe and a controller of the plurality of controllers.

12 Claims, 6 Drawing Sheets

(56) References Cited

U.S. PATENT DOCUMENTS

| | | | |
|---|---|---|---|
| 2019/0293306 | A1 | 9/2019 | Taniguchi et al. |
| 2020/0154603 | A1 | 5/2020 | Mizutani et al. |

FOREIGN PATENT DOCUMENTS

| | | | |
|---|---|---|---|
| JP | 2002-243246 | A | 8/2002 |
| JP | 2014-102050 | A | 6/2014 |
| JP | 5516602 | B2 | 6/2014 |
| NO | 2019/008634 | A1 | 1/2019 |
| WO | 2013/039047 | A1 | 3/2013 |
| WO | 2018/051499 | A1 | 3/2018 |
| WO | 2019/069470 | A1 | 4/2019 |
| WO | 2019/082783 | A1 | 5/2019 |

OTHER PUBLICATIONS

Office Action dated Jun. 21, 2022 issued in corresponding JP Patent Application No. 2021-521653 (and English translation). .

International Search Report dated Aug. 6, 2019, issued in corresponding International Application No. PCT/JP2019/021302 (and English Machine Translation).

REFRIGERATION CYCLE DEVICE

CROSS REFERENCE TO RELATED APPLICATION

This application is a U.S. National Stage Application of International Application No. PCT/JP2019/021302, filed on May 29, 2019, the contents of which are incorporated herein by reference.

TECHNICAL FIELD

The present disclosure relates to a refrigeration cycle device that includes a cooling mechanism for a controller.

BACKGROUND ART

In a known technique, for cooling a controller, a portion of refrigerant is caused to flow into a bypass from a main stream on the high-pressure side of a refrigerant circuit. The bypassed refrigerant is caused to reject heat in a pre-cooling heat exchanger. Thereafter, the refrigerant from which heat is rejected flows into a refrigerant cooler. Then, heat is exchanged between the controller and the refrigerant flowing through the refrigerant cooler to cool the controller. The portion of the refrigerant that is caused to flow into the bypass from the main stream on the high-pressure side cools the controller in the refrigerant cooler and, thereafter, flows to the low-pressure side of the refrigerant circuit through an expansion device that controls the flow rate of the refrigerant in the refrigerant cooler.

CITATION LIST

Patent Literature

Patent Literature 1: Japanese Patent No. 5516602

SUMMARY OF INVENTION

Technical Problem

In Patent Literature 1, the flow rate of the refrigerant is controlled by the expansion device such that the temperature of the controller falls within a range of the dew point temperature or above and equal to or below the overtemperature limit. However, when a structure is adopted where a plurality of heat generators having different amounts of heat generation are cooled in series with one flow passage and one expansion device, a situation occurs where the plurality of heat generators cannot be simultaneously controlled to temperature values that fall within the range of the dew point temperature or above and equal to or below the overtemperature limit. When a structure is adopted where a plurality of heat generators having different amounts of heat generation are cooled in parallel with a plurality of expansion devices, it is necessary to provide the expansion devices and pipes for the heat generators and hence, costs may be increased.

Even in the case of simultaneously cooling the plurality of heat generators, refrigerant passes through the pipes of the refrigerant cooler, so that plates of the refrigerant cooler are cooled. When the temperature of even one plate in the vicinity of the controller is equal to or below the dew point temperature of air, condensation forms. The condensation water stuck on the controller may lead to failure of the controller. Particularly, a problem occurs when condensation forms on the plates of the side on which the controller is attached.

The present disclosure has been made in view of the above-mentioned circumstances, and it is an object of the present disclosure to provide a refrigeration cycle device including a plurality of refrigerant coolers that can safely cool controllers for the refrigerant coolers at low cost.

Solution to Problem

An embodiment according to the present disclosure is directed to a refrigeration cycle device including: a refrigerant circuit including a compressor, a heat-source-side heat exchanger, a first expansion device, and a load-side heat exchanger, refrigerant cycling through the compressor, the heat-source-side heat exchanger, the first expansion device, and the load-side heat exchanger; a plurality of controllers configured to control the refrigerant circuit; a bypass pipe branching from a high pressure pipe on a discharge side of the compressor and connected to a low pressure pipe on a suction side of the compressor; a second expansion device provided to the bypass pipe, and configured to adjust a flow rate of the refrigerant flowing through the bypass pipe; and a plurality of refrigerant coolers provided to the bypass pipe, and configured to cool the plurality of controllers by using the refrigerant the flow rate of which is adjusted by the second expansion device, each of the plurality of refrigerant coolers including a refrigerant cooling pipe and a plate, the refrigerant cooling pipe forming the bypass pipe, the plate being joined between the refrigerant cooling pipe and a controller of the plurality of controllers.

Advantageous Effects of Invention

According to an embodiment of the present disclosure, the flow rate of refrigerant flowing through the bypass pipe can be adjusted by the second expansion device and hence, it is possible to safely cool, at low cost, the controllers for the plurality of refrigerant coolers provided to the bypass pipe.

DESCRIPTION OF EMBODIMENTS

Figure 1:
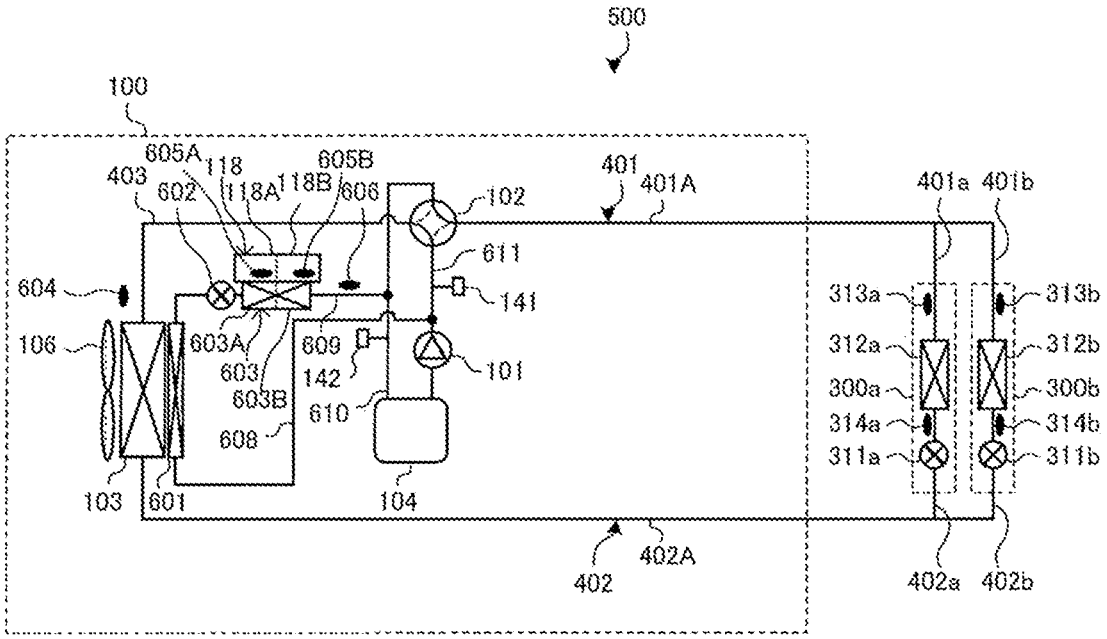
FIG. 1 is a schematic configuration diagram showing one example of the configuration of a refrigerant circuit of an air-conditioning device according to Embodiment.

Hereinafter, an air-conditioning device being one example of a refrigeration cycle device will be described with reference to drawings and the like. In the drawings described hereinafter including FIG. 1, components given the same reference symbols are identical or corresponding components, and the same goes for the entire of Embodiment described hereinafter. Modes of constitutional elements described throughout the description are merely for the sake of example, and are not limited to modes described herein. Further, a high or a low of temperature or pressure, for example, is not particularly determined based on the relationship with the absolute value, but is determined relatively based on the state, the action or the like of a system or a device, for example.

Embodiment

FIG. 1 is a schematic configuration diagram showing one example of the configuration of a refrigerant circuit of an air-conditioning device 500 according to Embodiment. Prior to the description of refrigerant cooling, the flow of refrigerant in a refrigeration cycle will be described. In the description, the configuration of the refrigerant circuit of the air-conditioning device 500 will be described based on FIG. 1. The air-conditioning device 500 is installed in a building or a condominium, for example, to perform a cooling operation or a heating operation by making use of a refrigeration cycle (heat pump cycle) through which refrigerant is caused to cycle.

The air-conditioning device 500 includes a heat-source-side unit 100 and a plurality of (two in FIG. 1) load-side units 300. The load-side units 300 includes a load-side unit 300*a* and a load-side unit 300*b*. In the air-conditioning device 500, the heat-source-side unit 100, the load-side unit 300*a*, and the load-side unit 300*b* are connected with each other by a gas extension pipe 401 and a liquid extension pipe 402 to form the refrigeration cycle. The gas extension pipe 401 includes a main gas pipe 401A, a branch gas pipe 401*a*, and a branch gas pipe 401*b*. The liquid extension pipe 402 includes a main liquid pipe 402A, a branch liquid pipe 402*a*, and a branch liquid pipe 402*b*.

[Heat-Source-Side Unit 100]

The heat-source-side unit 100 has a function of supplying cooling energy or heating energy to the load-side units 300.

The heat-source-side unit 100 mounts a compressor 101, a four-way switching valve 102 that is a flow passage switching device, a heat-source-side heat exchanger 103, and an accumulator 104 thereon. These apparatuses are connected in series to form a portion of a main refrigerant circuit. A heat-source-side fan 106 is also mounted on the heat-source-side unit 100.

The compressor 101 suctions gas refrigerant of low temperature and low pressure, compresses the refrigerant into gas refrigerant of high temperature and high pressure, and then discharges the refrigerant to cause the refrigerant to cycle through the refrigerant circuit for an operation relating to air conditioning. It is preferable that the compressor 101 be an inverter compressor where the capacity of the compressor can be controlled, for example. However, the compressor 101 is not limited to the inverter compressor where the capacity of the compressor can be controlled. For example, the compressor 101 may be a constant speed compressor or a compressor obtained by combining an inverter compressor and a constant speed compressor. It is sufficient for the compressor 101 to be able to compress suctioned refrigerant into a high pressure state, and the type of the compressor 101 is not particularly limited. For example, the compressor 101 may be any of various types, such as a reciprocating compressor, a rotary compressor, a scroll compressor, or a screw compressor.

The four-way switching valve 102 is provided close to the discharge side of the compressor 101 to switch a refrigerant flow passage between the cooling operation and the heating operation. The four-way switching valve 102 controls the flow of refrigerant such that the heat-source-side heat exchanger 103 serves as an evaporator or a condenser according to an operation mode.

The heat-source-side heat exchanger 103 causes heat exchange to be performed between refrigerant and a heat medium, such as ambient air or water. During the heating operation, the heat-source-side heat exchanger 103 serves as an evaporator, thus evaporating and gasifying refrigerant. During the cooling operation, the heat-source-side heat exchanger 103 serves as a condenser being a radiator, thus condensing and liquefying refrigerant.

As in the case of Embodiment, in the case where the heat-source-side heat exchanger 103 is an air-cooled heat exchanger, the heat-source-side unit 100 includes an air-sending device, such as the heat-source-side fan 106. Condensation capacity or evaporation capacity of the heat-source-side heat exchanger 103 is controlled by controlling, for example, the rotation speed of the heat-source-side fan 106 by a controller 118, which will be described later. In the case where the heat-source-side heat exchanger 103 is a water-cooled heat exchanger, condensation capacity or evaporation capacity of the heat-source-side heat exchanger 103 is controlled by controlling the rotation speed of a water cycle pump (not shown in the drawing).

The accumulator 104 is provided close to the suction side of the compressor 101, and has a function of separating liquid refrigerant and gas refrigerant from each other and a function of storing excess refrigerant therein.

The heat-source-side unit 100 includes a high pressure sensor 141 that detects pressure (high-pressure-side pressure) of refrigerant discharged from the compressor 101. The heat-source-side unit 100 also includes a low pressure sensor 142 that detects pressure (low-pressure-side pressure) of refrigerant to be suctioned by the compressor 101. The heat-source-side unit 100 further includes an outside air temperature sensor 604, a controller temperature sensor 605, and a temperature sensor 606, the outside air temperature sensor 604 detecting the temperature of outside air, the controller temperature sensor 605 detecting the temperature of the controller 118, the temperature sensor 606 detecting temperature of a pipe disposed downstream of a refrigerant cooler 603. The respective sensors transmit signals relating to detected pressures and signals relating to detected temperatures to the controller 118 that controls the action of the air-conditioning device 500.

The controller 118 performs, based on high-pressure-side pressure and low-pressure-side pressure, control of driving frequency of the compressor 101, the rotation speed of the heat-source-side fan 106, and switching of the four-way switching valve 102, for example. The controller 118 also controls an expansion device 602, which will be described later, based on detected pressures and detected temperatures from the respective sensors.

The controller 118 controls the air-conditioning device 500 by mainly controlling apparatuses included in the heat-source-side unit 100. The controller 118 may be a microcomputer, for example. For example, the controller 118 includes a control arithmetic processing unit, such as a central processing unit (CPU). The controller 118 also includes a storage unit (not shown in the drawing) that contains data where processing procedures relating to control and the like are programmed. The control arithmetic processing unit performs processing based on data of the program to achieve control of apparatuses forming the heat-source-side unit 100. In Embodiment, the controller 118 is installed in the heat-source-side unit 100. However, the place of installation of the controller 118 is not particularly limited provided that the controller 118 can control the apparatuses and the like.

The heat-source-side unit 100 further includes a bypass pipe 608 that branches from a high pressure pipe 611 and that is connected to a low pressure pipe 610, high pressure gas refrigerant discharged from the compressor 101 passing through the high pressure pipe 611, the low pressure pipe 610 being provided on the suction side of the compressor 101. The bypass pipe 608 is a bypass that causes high pressure gas refrigerant forming a main stream to pass therethrough. The bypass pipe 608 is provided with a pre-cooling heat exchanger 601 configured to cool high pressure gas refrigerant that flows into the bypass pipe 608. The expansion device 602 and the refrigerant cooler 603 are provided downstream of the pre-cooling heat exchanger 601, the expansion device 602 adjusting a flow rate in the bypass pipe, the refrigerant cooler 603 cooling the controller 118.

The expansion device 602 has a function as a pressure reducing valve or an expansion valve, and causes refrigerant to expand by reducing the pressure of the refrigerant. The expansion device 602 has a role of reducing the pressure of high pressure refrigerant, cooled by the pre-cooling heat exchanger 601, to further reduce the temperature of the refrigerant, and thereafter causing the refrigerant to flow into the refrigerant cooler 603. The expansion device 602 is a device where the opening degree of the device can be variably controlled. For example, the expansion device 602 may be an electronic expansion valve.

The pre-cooling heat exchanger 601 forms an integral heat exchanger in conjunction with the heat-source-side heat exchanger 103. The pre-cooling heat exchanger 601 forms the portion of the integral heat exchanger. The pre-cooling heat exchanger 601 may be formed as a separate body from the heat-source-side heat exchanger 103.

The refrigerant cooler 603 includes a refrigerant pipe through which refrigerant passes. The refrigerant cooler 603 is formed such that the refrigerant pipe is caused to be in contact with the controller 118. Refrigerant that flows into the bypass pipe 608 is cooled by the pre-cooling heat exchanger 601, thus becoming liquid refrigerant. Then, the flow rate of the liquid refrigerant is adjusted by the expansion device 602 and, thereafter, the liquid refrigerant flows into the refrigerant cooler 603. The liquid refrigerant that flows into the refrigerant cooler 603 receives heat generated from the controller 118, thus becoming gas refrigerant. The refrigerant formed into gas refrigerant passes through a refrigerant cooler downstream pipe 609 disposed downstream of the refrigerant cooler 603, passes through the low pressure pipe 610, and then flows into the accumulator 104.

[Load-Side Unit 300]

The load-side units 300 supply cooling energy or heating energy from the heat-source-side unit 100 to a cooling load or a heating load. For example, in the illustration in FIG. 1, "a" is appended to the reference symbol for each apparatus included in "the load-side unit 300*a*", and "b" is appended to the reference symbol for each apparatus included in "the load-side unit 300*b*".

In the description made hereinafter, "a" or "b" that is appended to the reference symbol may be omitted. However, respective apparatuses are provided to each of the load-side unit 300*a* and the load-side unit 300*b*.

A load-side heat exchanger 312 and an expansion device 311 are mounted on each load-side unit 300 in a state of being connected in series. The load-side units 300 form the refrigerant circuit in conjunction with the heat-source-side unit 100. The load-side heat exchangers 312 include a load-side heat exchanger 312*a* and a load-side heat exchanger 312*b*. The expansion devices 311 include an expansion device 311*a* and an expansion device 311*b*. It is preferable to provide air-sending devices not shown in the drawing for supplying air to the load-side heat exchangers 312. The load-side heat exchangers 312 may be configured to cause heat exchange to be performed between refrigerant and a heat medium that is different from the refrigerant, such as water.

Each load-side heat exchanger 312 causes heat exchange to be performed between refrigerant and a heat medium, such as ambient air or water. During the heating operation, the load-side heat exchanger 312 serves as a condenser being a radiator, thus condensing and liquefying refrigerant. During the cooling operation, the load-side heat exchanger 312 serves as an evaporator, thus evaporating and gasifying refrigerant. In general, the load-side heat exchanger 312 is formed in combination with the air-sending device not shown in the drawing. Condensation capacity or evaporation capacity of the load-side heat exchanger 312 is controlled by controlling the rotation speed of the air-sending devices.

Each expansion device 311 has a function as a pressure reducing valve or an expansion valve. The expansion device 311 causes refrigerant to expand by reducing the pressure of the refrigerant. It is preferable that the expansion device 311 be a device where the opening degree of the device can be variably controlled. The expansion device 311 may be a flow rate control device that precisely controls a flow rate by an electronic expansion valve or may be an inexpensive refrigerant flow rate adjustment component, such as a capillary tube, for example.

The load-side units 300 include the load-side unit 300*a* and the load-side unit 300*b*. The load-side unit 300*a* is provided with at least the expansion device 311*a*, the load-side heat exchanger 312*a*, a temperature sensor 313*a*, and a temperature sensor 314*a*. The temperature sensor 313*a* detects the temperature of a refrigerant pipe disposed between the load-side heat exchanger 312 and the four-way switching valve 102. The temperature sensor 314*a* detects the temperature of a refrigerant pipe disposed between the expansion device 311*a* and the load-side heat exchanger 312*a*. The load-side unit 300*b* is provided with at least the expansion device 311*b*, the load-side heat exchanger 312*b*, a temperature sensor 313*b*, and a temperature sensor 314*b*. The temperature sensor 313*b* detects the temperature of a refrigerant pipe disposed between the load-side heat exchanger 312 and the four-way switching valve 102. The temperature sensor 314*b* detects the temperature of a refrigerant pipe disposed between the expansion device 311*b* and the load-side heat exchanger 312*b*.

Temperature information detected by the various detection units is transmitted to the controller 118 that controls the action of the air-conditioning device 500, and is used for control of various actuators forming the air-conditioning device 500. That is, information from the temperature sensor 313 and the temperature sensor 314 is used for control of the opening degree of the expansion device 311 provided to the load-side unit 300 or control of the rotation speed of the air-sending device not shown in the drawing, for example.

The kind of refrigerant used for the air-conditioning device 500 is not particularly limited, and any refrigerant may be used. Examples of refrigerant may be a natural refrigerant, such as carbon dioxide, hydrocarbon, or helium, an alternative refrigerant containing no chlorine, such as HFC410A, HFC407C, or HFC404A, or a fluorocarbon refrigerant used in existing products, such as R22 or R134a.

FIG. 1 shows an example where the controller 118 that controls the action of the air-conditioning device 500 is mounted on the heat-source-side unit 100. However, the controller 118 may be provided to the load-side unit 300.

The controller 118 may also be provided outside the heat-source-side unit 100 and the load-side unit 300. Alternatively, the controller 118 may be divided into two or more controllers having different functions, and the two or more controllers may be individually provided to the heat-source-side unit 100 and the load-side unit 300. In this case, it is preferable that the respective controllers be connected by wireless or wired communication to allow communication.

Next, the operation action performed by the air-conditioning device 500 will be described.

The air-conditioning device 500 receives a request for the cooling operation or a request for the heating operation from a remote control or the like that is installed in a room, for example. The air-conditioning device 500 performs an air conditioning action for either one of two operation modes corresponding to a request. The two operation modes include a cooling operation mode and a heating operation mode.

[Cooling Operation Mode]

Figure 2:
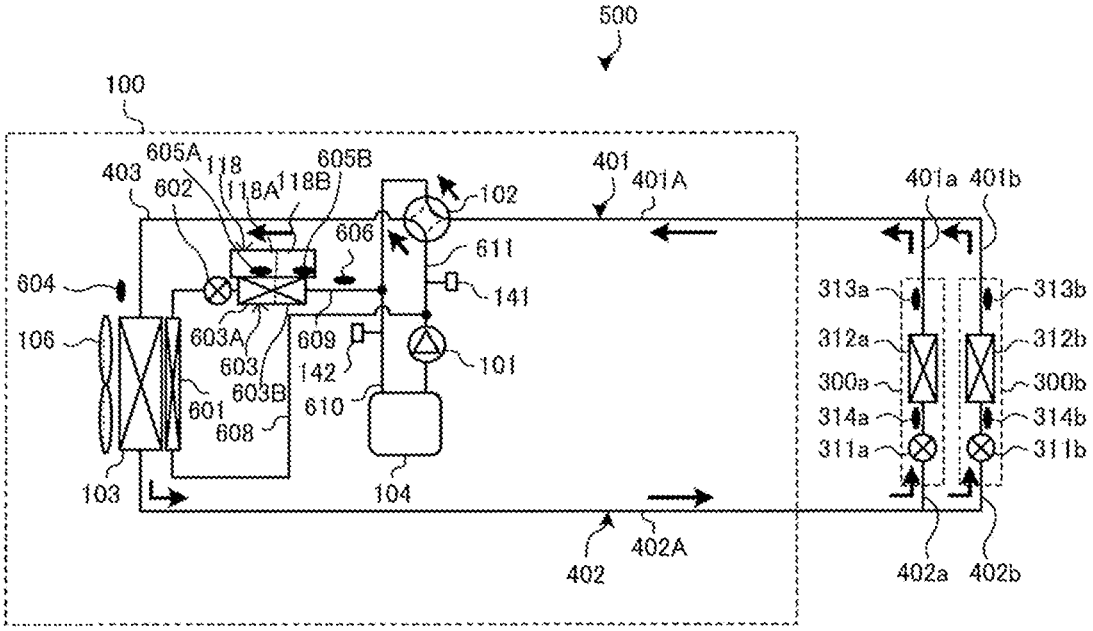
FIG. 2 is a diagram showing the flow of refrigerant when the air-conditioning device according to Embodiment is in a cooling operation mode.

FIG. 2 is a diagram showing the flow of refrigerant when the air-conditioning device 500 according to Embodiment is in the cooling operation mode. The operation action of the air-conditioning device 500 in the cooling operation mode will be described based on FIG. 2.

The compressor 101 compresses refrigerant of low temperature and low pressure, and then discharges gas refrigerant of high temperature and high pressure. The gas refrigerant of high temperature and high pressure discharged from the compressor 101 passes through the high pressure pipe 611, the four-way switching valve 102, and a low pressure pipe 403, and then flows into the heat-source-side heat exchanger 103. The heat-source-side heat exchanger 103 serves as a condenser and hence, the refrigerant exchanges heat with ambient air, thus being condensed and liquefied. The liquid refrigerant that flows out from the heat-source-side heat exchanger 103 flows out from the heat-source-side unit 100 through the main liquid pipe 402A.

The high pressure liquid refrigerant that flows out from the heat-source-side unit 100 flows into the load-side unit 300*a* through the branch liquid pipe 402*a* and into the load-side unit 300*b* through the branch liquid pipe 402*b*. The liquid refrigerant that flows into the load-side unit 300*a* is throttled by the expansion device 311*a* and the liquid refrigerant that flows into the load-side unit 300*b* is throttled by the expansion device 311*b*, so that the liquid refrigerant becomes low-temperature two-phase gas-liquid refrigerant. The low-temperature two-phase gas-liquid refrigerant flows into the load-side heat exchanger 312*a* and the load-side heat exchanger 312*b*.

The load-side heat exchangers 312*a* and 312*b* serve as evaporators and hence, the refrigerant exchanges heat with ambient air, thus being evaporated and gasified. At this point of operation, the refrigerant removes heat from ambient air, so that a room is cooled. Thereafter, the refrigerant that flows out from the load-side heat exchanger 312*a* flows out from the load-side unit 300*a* through the branch gas pipe 401*a*, and the refrigerant that flows out from the load-side heat exchanger 312*b* flows out from the load-side unit 300*b* through the branch gas pipe 401*a*401*b*.

The refrigerant that flows out from the load-side units 300*a* and 300*b* returns to the heat-source-side unit 100 through the main gas pipe 401A. The gas refrigerant that returns to the heat-source-side unit 100 is suctioned by the compressor 101 again via the four-way switching valve 102 and the accumulator 104. The air-conditioning device 500 performs the cooling operation mode with the flow described above.

[Heating Operation Mode]

Figure 3:
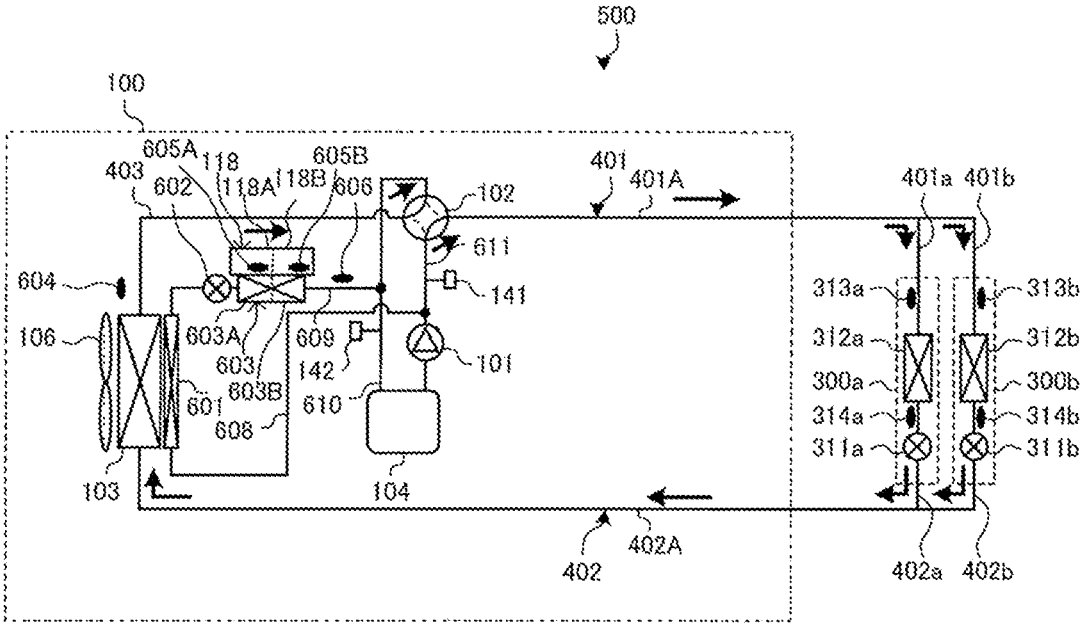
FIG. 3 is a refrigerant circuit diagram showing the flow of refrigerant when the air-conditioning device according to Embodiment is in a heating operation mode.

FIG. 3 is a refrigerant circuit diagram showing the flow of refrigerant when the air-conditioning device 500 according to Embodiment is in the heating operation mode. The operation action of the air-conditioning device 500 in the heating operation mode will be described based on FIG. 3.

Refrigerant of low temperature and low pressure is compressed by the compressor 101, thus becoming gas refrigerant of high temperature and high pressure, and the gas refrigerant is then discharged. The gas refrigerant of high temperature and high pressure discharged from the compressor 101 passes through the high pressure pipe 611 and the four-way switching valve 102, and then flows into the main gas pipe 401A. Thereafter, the refrigerant flows out from the heat-source-side unit 100. The gas refrigerant of high temperature and high pressure that flows out from the heat-source-side unit 100 flows into the load-side unit 300*a* through the branch gas pipe 401*a* and into the load-side unit 300*b* through the branch gas pipe 401*b*.

The gas refrigerant that flows into the load-side unit 300*a* flows into the load-side heat exchanger 312*a* and the gas refrigerant that flows into the load-side unit 300*b* flows into the load-side heat exchanger 312*b*. The load-side heat exchanger 312*a* and the load-side heat exchanger 312*b* serve as condensers and hence, the refrigerant exchanges heat with ambient air, thus being condensed and liquefied. At this point of operation, the refrigerant rejects heat to ambient air, so that an air-conditioned space, such as a room, is heated. Thereafter, the liquid refrigerant that flows out from the load-side heat exchanger 312*a* is reduced in pressure by the expansion device 311*a* and the liquid refrigerant that flows out from the load-side heat exchanger 312*b* is reduced in pressure by the expansion device 311*b*. The liquid refrigerant with reduced pressure flows out from the load-side unit 300*a* through the branch liquid pipe 402*a* and from the load-side unit 300*b* through the branch liquid pipe 402*b*.

The refrigerant that flows out from the load-side unit 300*a* and the load-side unit 300*b* returns to the heat-source-side unit 100 through the main liquid pipe 402A. The gas refrigerant that returns to the heat-source-side unit 100 flows into the heat-source-side heat exchanger 103. The heat-source-side heat exchanger 103 serves as an evaporator and hence, the refrigerant exchanges heat with ambient air, thus being evaporated and gasified. Thereafter, the refrigerant that flows out from the heat-source-side heat exchanger 103 flows into the accumulator 104 via the four-way switching valve 102. The compressor 101 suctions the refrigerant in the accumulator 104 to cause the refrigerant to cycle through the refrigerant circuit. The refrigeration cycle is established in this manner. The air-conditioning device 500 performs the heating operation mode with the flow described above.

[Refrigerant Cooler Structure]

Next, the structure of the refrigerant cooler 603 in Embodiment will be described.

In Embodiment, the description will be made for the case where the refrigerant cooler 603 includes two refrigerant coolers, that is, a refrigerant cooler 603A and a refrigerant cooler 603B, the refrigerant cooler 603A cools a controller 118A, and the refrigerant cooler 603B cools a controller 118B. In the case where three or more controllers are used, refrigerant coolers 603 corresponding to the controllers are present.

Figure 7:
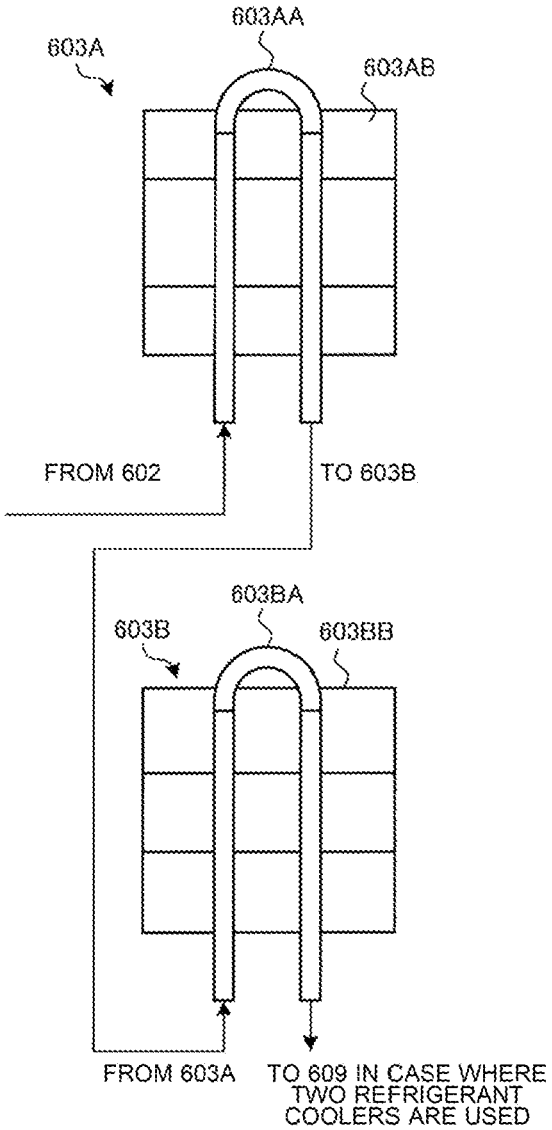
FIG. 7 is a diagram for describing one surface of each plate of a refrigerant cooler according to Embodiment.
Figure 8:
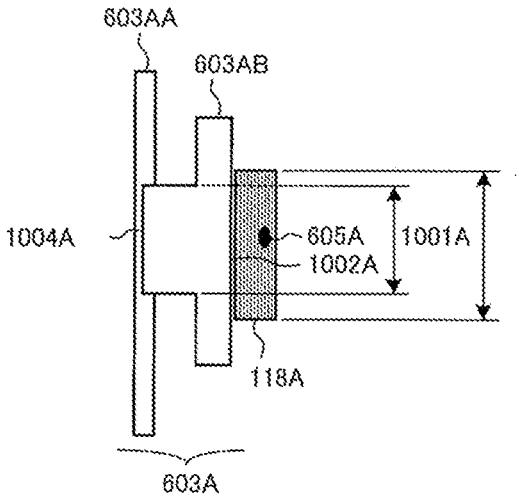
FIG. 8 is a diagram for describing a joining relationship between the controller, the plate and a refrigerant cooling pipe of the refrigerant cooler according to Embodiment.
Figure 9:
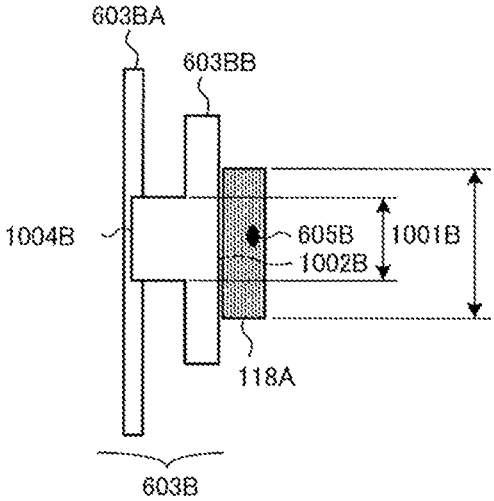
FIG. 9 is a diagram for describing the joining relationship between the controller, the plate and a refrigerant cooling pipe of the refrigerant cooler according to Embodiment.

FIG. 7 is a diagram for describing one surface of a plate 603AB of the refrigerant cooler 603A and one surface of a plate 603BB of the refrigerant cooler 603B according to Embodiment. FIG. 8 is a diagram for describing a joining relationship between the controller 118A, the plate 603AB and a refrigerant cooling pipe 603AA of the refrigerant cooler 603A according to Embodiment. FIG. 9 is a diagram for describing the joining relationship between the controller 118B, the plate 603BB and a refrigerant cooling pipe 603BA of the refrigerant cooler 603B according to Embodiment.

The refrigerant cooler 603A includes the refrigerant cooling pipe 603AA and the plate 603AB.

Hereinafter, the refrigerant cooling pipe 603AA and the plate 603AB of the refrigerant cooler 603A will be described as exemplars. The refrigerant cooling pipe 603BA and the plate 603BB of the refrigerant cooler 603B have substantially the same configuration as the refrigerant cooling pipe 603AA and the plate 603AB of the refrigerant cooler 603A.

As shown in FIG. 7, the refrigerant cooling pipe 603AA is joined to one surface of the plate 603AB to conduct heat to the plate 603AB. A joining method may be brazing, calking, screwing, or contact by silicon/grease, for example.

The refrigerant cooling pipe 603AA of the refrigerant cooler 603A is connected in series to the refrigerant cooling pipe 603BA of the refrigerant cooler 603B. Refrigerant from the expansion device 602 is inputted into the inlet of the refrigerant cooling pipe 603AA. The outlet of the refrigerant cooling pipe 603AA is connected to the inlet of the refrigerant cooling pipe 603BA of the refrigerant cooler 603B. Refrigerant from the refrigerant cooling pipe 603AA of the refrigerant cooler 603A is inputted into the inlet of the refrigerant cooling pipe 603BA of the refrigerant cooler 603B. The refrigerant cooler downstream pipe 609 is connected to the outlet of the refrigerant cooling pipe 603BA.

In the case where three or more refrigerant coolers 603 are used, the refrigerant cooling pipe of one refrigerant cooler is sequentially connected in series to the refrigerant cooling pipe of another refrigerant cooler in the same manner. As shown in FIG. 8, the controller 118A is joined to the other surface of the plate 603AB to conduct heat to the plate 603AB. That is, the refrigerant cooler 603A of Embodiment includes the refrigerant cooling pipe 603AA provided to the bypass pipe 608 and the plate 603AB joined between the refrigerant cooling pipe 603AA and the controller 118A.

The refrigerant cooler 603B includes the refrigerant cooling pipe 603BA provided to the bypass pipe 608 and the plate 603BB joined between the refrigerant cooling pipe 603BA and the controller 118B. With such a configuration, heat of the refrigerant cooling pipe 603AA is transferred to the controller 118A via the plate 603AB. Further, heat of the refrigerant cooling pipe 603BA is transferred to the controller 118B via the plate 603BB.

A contact portion 1004A between the refrigerant cooling pipe 603AA and the plate 603AB is formed on one surface of the plate 603AB. Further, a contact portion 1002A between the controller 118A and the plate 603AB is formed on the other surface, that is the back side, of the plate 603AB.

A corresponding region 1001A corresponding to the contact portion 1004A formed on the other surface, that is the back side, of the plate 603AB falls inside the range of a region 1003A of the contact portion 1002A. That is, the region 1003A of the contact portion 1004A is smaller than the region of the contact portion 1002A.

If the corresponding region 1001A of the contact portion 1004A exceeds the range of the region 1003A of the contact portion 1002A, the following problem occurs. For example, in the case where the refrigerant cooling pipe 603AA assumes a dew point temperature or below, even when the temperature of the controller 118A is controlled to the dew point temperature or above, the surface outside the region 1003A of the contact portion 1002A assumes a temperature equal to the dew point temperature or below, so that condensation forms. The condensation water thus formed may lead to failure of the controller 118A if it sticks to the controller 118A.

To prevent the above-mentioned problem, the corresponding region 1001A of the contact portion 1004A between the refrigerant cooling pipe 603AA and the plate 603AB is set to be inside the range of the region 1003A of the contact portion 1002A between the controller 118A and the plate 603AB. With such a configuration, even if the refrigerant cooling pipe 603AA assumes the dew point temperature or below, by controlling the temperature of the controller 118A to the dew point temperature or above, the surface outside the region 1003A where the controller 118A and the plate 603AB are joined also assumes a temperature equal to the dew point temperature or above and hence, condensation does not form.

The area of the contact portion 1004A between the refrigerant cooling pipe 603AA and the plate 603AB has a size that corresponds to the amount of heat generated from the controller 118A. The area of a contact portion 1004B between the refrigerant cooling pipe 603BA and the plate 603BB has a size that corresponds to the amount of heat generated from the controller 118B. For example, the area of the contact portion 1004A is set to a size proportional to the amount of heat generated from the controller 118A. The area of the contact portion 1004B is set to a size proportional to the amount of heat generated from the controller 118B.

In the case where the controller 118A and the controller 118B having different amounts of heat generation are connected with each other in a state where the controller 118A and the controller 118B have the same area for the region of the contact portion, condensation forms on the controller having a lower amount of heat generation, and the temperature of the controller having a higher amount of heat generation excessively rises. As a result, the controller 118A and the controller 118B cannot be controlled with the refrigerant cooling pipe 603AA and the refrigerant cooling pipe 603BA, which are connected in series, such that overheat temperature>controller 118A and controller 118B>dew point temperature are established.

According to Embodiment, the above-mentioned configuration is adopted and hence, it is possible to properly cool the controller 118A and the controller 118 having different amounts of heat generation with the refrigerant cooling pipes 603AA, 603BA connected in series such that overheat temperature>controller 118A and controller 118B>dew point temperature are established.

The above-mentioned description has been made for an example where two heat generators are used. However, the above-mentioned configuration is also applicable to the case where three or more heat generators are used.

[Refrigerant Cooling Control]

Next, a description will be made for refrigerant cooling control being an example of the case where Embodiment is applied.

Refrigerant cooling control is a control of cooling the controller 118 with refrigerant, and the same refrigerant cooling control is performed in either of the cooling operation mode or the heating operation mode. Therefore, hereinafter, the refrigerant cooling control will be described by using a diagram showing the flow of refrigerant in the cooling operation mode.

Figure 4:
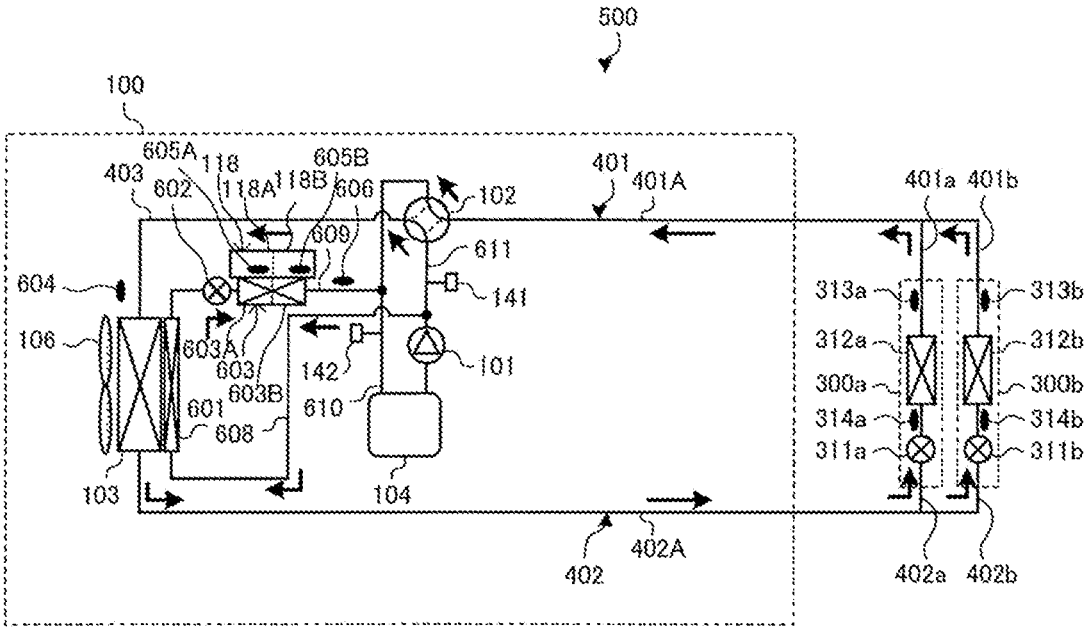
FIG. 4 is a refrigerant circuit diagram showing the flow of refrigerant during refrigerant cooling control when the air-conditioning device according to Embodiment is in the cooling operation mode.

FIG. 4 is a refrigerant circuit diagram showing the flow of refrigerant during the refrigerant cooling control when the air-conditioning device 500 according to Embodiment is in the cooling operation mode.

During the refrigerant cooling control, a portion of high pressure gas refrigerant passing through the high pressure pipe 611 is caused to flow into the bypass pipe 608, and flows into the pre-cooling heat exchanger 601. The liquid refrigerant that flows into the pre-cooling heat exchanger 601 exchanges heat with air from the heat-source-side fan 106, thus being cooled. The liquid refrigerant cooled by the pre-cooling heat exchanger 601 thus having low pressure is further reduced in pressure by the expansion device 602, thus having an even lower pressure. Thereafter, the liquid refrigerant flows into the refrigerant cooler 603. In the refrigerant cooler 603, the refrigerant exchanges heat with the controller 118, thus evaporating. At this point of operation, the refrigerant removes heat from the controller 118 to cool the controller 118. After the refrigerant cools the controller 118, the refrigerant becomes gas refrigerant or two-phase refrigerant, flows through the low pressure pipe 610, and flows into the accumulator 104.

The flow rate of refrigerant flowing through the refrigerant cooler 603 is adjusted by the expansion device 602. The expansion device 602 is controlled by the controller 118 based on information obtained from the controller temperature sensor 605. Hereinafter, specific control of the expansion device 602 will be described.

Figure 5:
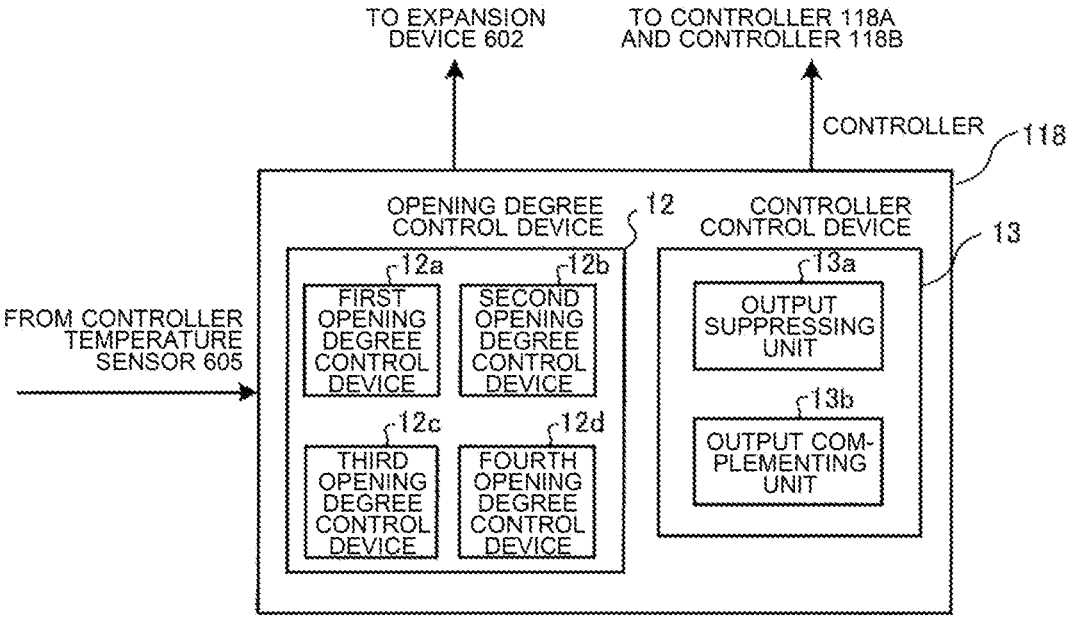
FIG. 5 is a function block diagram for describing control of a controller according to Embodiment.

FIG. 5 is a function block diagram for describing control of the controller 118 according to Embodiment. A function described below may be achieved by the controller 118A and/or the controller 118B. Alternatively, the function described below may be achieved by a controller provided separately from the controller 118A and the controller 118B.

As shown in FIG. 5, the controller 118 includes an opening degree control device 12 and a controller control device 13.

The opening degree control device 12 controls the opening degree of the expansion device 602 based on the temperature signal of the controller 118A from a controller temperature sensor 605A and the temperature signal of the controller 118B from a controller temperature sensor 605B.

The opening degree control device 12 includes a first opening degree control device 12*a*, a second opening degree control device 12*b*, a third opening degree control device 12*c*, and a fourth opening degree control device 12*d*.

The first opening degree control device 12*a* performs a control of increasing the opening degree of the expansion device 602 in the case where a condition is satisfied in which, of the temperatures of the controller 118A and the controller 118B, the highest temperature is equal to or above a predetermined temperature and the lowest temperature is equal to or above a predetermined temperature.

The second opening degree control device 12*b* performs a control of reducing the opening degree of the expansion device 602 in the case where a condition is satisfied in which, of the temperatures of the controller 118A and the controller 118B, the highest temperature is below the predetermined temperature and the lowest temperature is below the predetermined temperature.

The third opening degree control device 12*c* performs a control of reducing the opening degree of the expansion device 602 such that the average of the temperatures of the controller 118A and the controller 118B reaches a target temperature in the case where the condition is not satisfied in which, of the temperatures of the controller 118A and the controller 118B, the highest temperature is below the predetermined temperature and the lowest temperature is below the predetermined temperature, and a condition is satisfied in which the average of the temperatures of the controller 118A and the controller 118B is below the target temperature.

The fourth opening degree control device 12*d* performs a control of increasing the opening degree of the expansion device 602 such that the average of the temperatures of the controller 118A and the controller 118B reaches the target temperature in the case where the condition is not satisfied in which, of the temperatures of the controller 118A and the controller 118B, the highest temperature is below the predetermined temperature and the lowest temperature is below the predetermined temperature, and a condition is satisfied in which the average of the temperatures of the controller 118A and the controller 118B is equal to or above the target temperature.

The controller control device 13 controls an output from the controller 118A and an output from the controller 118B based on the temperature signal of the controller 118A from the controller temperature sensor 605A and the temperature signal of the controller 118B from the controller temperature sensor 605B.

The controller control device 13 includes an output suppressing unit 13*a* and an output complementing unit 13*b*.

The output suppressing unit 13*a* performs a control of suppressing an output from a controller having the highest temperature in the case where a condition is not satisfied in which, of the temperatures of the controller 118A and the controller 118B, the highest temperature is equal to or above the predetermined temperature and the lowest temperature is equal to or above the predetermined temperature, and a condition is satisfied in which, of the temperatures of the controller 118A and the controller 118B, the highest temperature is equal to or above a predetermined temperature.

In the case where an output from either the controller 118A or the controller 118B whichever has the highest temperature is suppressed by the output suppressing unit 13*a*, the output complementing unit 13*b* complements the output from either the controller 118A or the controller 118B whichever has the highest temperature with the output from the other of the controller 118A or the controller 118B.

Figure 6:
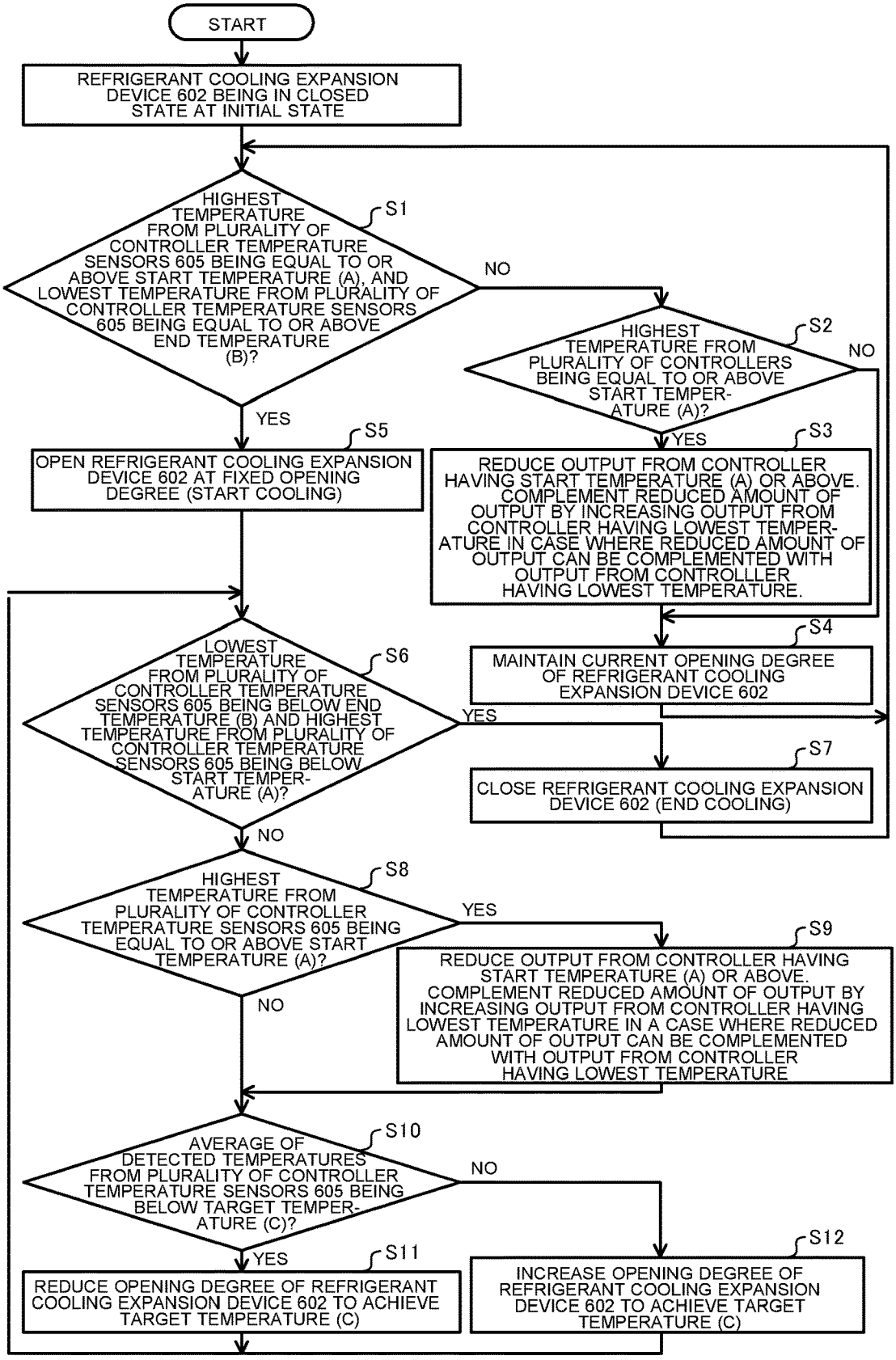
FIG. 6 is a flowchart showing control of an expansion device of the air-conditioning device according to Embodiment during refrigerant cooling control.

FIG. 6 is a flowchart showing control of the expansion device 602 of the air-conditioning device 500 according to Embodiment during the refrigerant cooling control. In the description made hereinafter, (A) to (C) indicating temperatures have the relationship of (B)<(C)<(A).

In an initial state, the expansion device 602 is in a closed state. After the operation of the air-conditioning device 500 is started, the controller 118 determines whether, of temperatures detected by the controller temperature sensor 605A and the controller temperature sensor 605B, the highest detected temperature is, for example, equal to or above a start temperature (A) of 75 degrees C. set in advance and the lowest detected temperature is, for example, equal to or above an end temperature (B) of 60 degrees C. (S1).

When it is not determined in step S1 that the highest detected temperature is equal to or above the start temperature (A) set in advance and the lowest detected temperature is equal to or above the end temperature (B) (NO in S1), it is determined whether the highest detected temperature of the controller 118A or the controller 118B is equal to or above the start temperature (A) set in advance (S2).

When it is determined in step S2 that the highest detected temperature is equal to or above the start temperature (A) set in advance (YES in S2), it is necessary to reduce the temperature of either the controller 118A or the controller 118B whichever has the highest detected temperature without using refrigerant cooling and hence, the output suppressing unit 13*a* reduces an output from either the controller 118A or the controller 118B whichever has the highest detected temperature to reduce the amount of heat generation. In the case where the reduced output from the controller 118A or the controller 118B can be complemented with the output from either the controller 118A or the controller 118B whichever has the lowest detected temperature, the output complementing unit 13*b* increases the output from either the controller 118A or the controller 118B whichever has the lowest detected temperature to complement shortage of the output (S3).

In step S3 or when it is determined in step S2 that the highest detected temperature is not equal to or above the start temperature (A) set in advance (NO in S2), that is, the detected temperature is below the start temperature (A) or the detected temperature is below the end temperature (B), it is unnecessary to cool the controller 118. Therefore, the current opening degree of the expansion device 602 is maintained, that is, the closed state of the expansion device 602 is maintained (S4) to prevent refrigerant from flowing into the refrigerant cooler 603.

When it is determined in step S1 that the highest detected temperature is equal to or above the start temperature (A) set in advance and the lowest detected temperature is equal to or above the end temperature (B) (YES in S1), the first opening degree control device 12*a* opens the expansion device 602 at a fixed opening degree set in advance (S5). With such an operation, refrigerant flows into the refrigerant cooler 603, so that cooling of the controller 118 is started and hence, the temperature of the controller 118 reduces.

The controller 118 checks the detected temperature from the controller temperature sensor 605 to determine whether the highest detected temperature from the controller temperature sensor 605 is below the start temperature (A) set in advance and the lowest detected temperature is below the end temperature (B) (S6).

When it is determined in step S6 that, of the detected temperatures from the controller temperature sensor 605, the highest detected temperature is below the start temperature (A) set in advance and the lowest detected temperature is below the end temperature (B) (YES in S6), the second opening degree control device 12*b* closes the expansion device 602 to end cooling of the controller 118A and the controller 118B (S7). Then, the processing returns to step S1.

In contrast, it is not determined in step S6 that, of the detected temperatures from the controller temperature sensor 605, the highest detected temperature is below the start temperature (A) set in advance and the lowest detected temperature is below the end temperature (B) (NO in S6), next, the processing in step S8 is performed.

In step S8, it is determined whether the highest detected temperature is equal to or above the start temperature (A). When it is determined in step S8 that the highest detected temperature is equal to or above the start temperature (A) (YES in S8), it is necessary to reduce the temperature of either the controller 118A or the controller 118B whichever has the highest detected temperature with current refrigerant cooling capacity and hence, the output suppressing unit 13*a* reduces an output from either the controller 118A or the controller 118B whichever has the highest detected temperature to reduce the amount of heat generation. In the case where the reduced output from the controller 118A or the controller 118B can be complemented with the output from either the controller 118A or the controller 118B whichever has the lowest detected temperature, the output complementing unit 13*b* increases the output from either the controller 118A or the controller 118B whichever has the lowest detected temperature to complement shortage of the output (S9).

Subsequently, it is determined whether the average of the detected temperatures from the controller temperature sensor 605A and the controller temperature sensor 605B is below a target temperature (C) of 70 degrees C., for example, set in advance (S10).

In the case where it is determined in step S10 that the average of the detected temperatures from the controller temperature sensor 605A and the controller temperature sensor 605B is below the target temperature (C) set in advance (YES in S10), the third opening degree control device 12*c* performs the control of reducing the opening degree of the expansion device 602 such that the temperatures of the controller 118A and the controller 118B reach the target temperature (C) when the average of the temperatures of the controller 118A and the controller 118B is below the target temperature (S11). Then, the processing returns to the processing in step S6.

When the detected temperatures from the controller temperature sensor 605A and the controller temperature sensor 605B match the target temperature (C), the current opening degree may be maintained.

In contrast, when the average of the detected temperatures from the controller temperature sensor 605A and the controller temperature sensor 605B is equal to or above the target temperature (C) (NO in S10), the fourth opening degree control device 12*d* increases the opening degree of the expansion device 602 such that the average of the detected temperatures from the controller temperature sensor 605A and the controller temperature sensor 605B reaches the target temperature (C) (S12). Then, the processing returns to step S6, and the same processing is repeated.

The controller 118 is cooled by the above-mentioned refrigerant cooling control. Specific numerical values of respective temperatures in the above-mentioned description are given merely for the sake of example, and may be suitably set according to actual use conditions, for example.

The expansion device 311 in Embodiment is also referred to as a first expansion device, and a second expansion device is also referred to as the expansion device 602 in Embodiment. The contact portion 1004 is also referred to as a first contact portion, and the contact portion 1002 is also referred to as a second contact portion.

Embodiment shows an example of the air-conditioning device 500 including one heat-source-side unit 100A and two load-side units 300. However, the number of each unit is not particularly limited. In Embodiment, the description has been made for an example of the air-conditioning device 500A that can be operated in a state where the load-side unit 300 is switched to either one of the cooling operation or the heating operation. However, a device to which Embodiment is applicable is not limited to such a device. Examples of another device to which Embodiment is applicable may be a refrigeration cycle device or a refrigeration system where a load is heated by supplying capacity. That is, Embodiment is also applicable to another device where a refrigerant circuit is formed by making use of a refrigeration cycle.

In the above-mentioned description, Embodiment has been described as an exemplar. However, Embodiment may also be carried out even in the mode described in Japanese Patent No. 5516602 where an air-conditioning device includes an expansion device that adjusts the flow rate of refrigerant in a refrigerant cooling device.

Embodiment is presented for the sake of example, and is not intended to limit the scope of Embodiment. Various modifications of Embodiment are conceivable, and various omissions, substitutions, and changes may be made without departing from the gist of Embodiment. These Embodiment and modifications of Embodiment are also included in the scope and gist of Embodiment.

REFERENCE SIGNS LIST

12, 12*a* to 12*d*: opening degree control device, 13, 13*a*, 13*b*: controller control device 100: heat-source-side unit, 101: compressor, 102: four-way switching valve, 103: heat-source-side heat exchanger, 104: accumulator, 106: heat-source-side fan, 118, 118A, 118B: controller, 141: high pressure sensor, 142: low pressure sensor, 300 (300*a*, 300*b*): load-side unit, 311, 311*a*, 311*b*: expansion device, 312, 312*a*, 312*b*: load-side heat exchanger, 313*a*, 313*b*: temperature sensor, 314, 314*a*, 314*b*: temperature sensor, 401: gas extension pipe, 401A: main gas pipe, 401*a*: branch gas pipe, 401*b*: branch gas pipe, 402: liquid extension pipe, 402A: main liquid pipe, 402*a*: branch liquid pipe, 402*b*: branch liquid pipe, 403: low pressure pipe, 500: air-conditioning device, 601: pre-cooling heat exchanger, 602: expansion device, 603, 603A, 603B: refrigerant cooler, 603AA, 603BA: refrigerant cooling pipe, 603AB, 603BB: plate, 604: outside air temperature sensor, 605, 605A, 605B: controller temperature sensor, 606: temperature sensor, 608: bypass pipe, 609: refrigerant cooler downstream pipe, 610: low pressure pipe, 611: high pressure pipe, 1001: corresponding region of contact portion between refrigerant cooling pipe and plate, 1002: contact portion between controller and plate, 1003: region of contact portion between controller and plate, 1004: contact portion between refrigerant cooling pipe and plate.

The invention claimed is:

1. A refrigeration cycle device comprising:

a refrigerant circuit including a compressor, a heat-source-side heat exchanger, a first expansion device, and a load-side heat exchanger, refrigerant cycling through the compressor, the heat-source-side heat exchanger, the first expansion device, and the load-side heat exchanger;

a plurality of controllers configured to control the refrigerant circuit;

a bypass pipe branching from a high pressure pipe on a discharge side of the compressor and connected to a low pressure pipe on a suction side of the compressor;

a second expansion device provided to the bypass pipe, and configured to adjust a flow rate of the refrigerant flowing through the bypass pipe; and a plurality of refrigerant coolers provided to the bypass pipe, and configured to cool the plurality of controllers by using the refrigerant the flow rate of which is adjusted by the second expansion device, each of the plurality of refrigerant coolers including a refrigerant cooling pipe and a plate, the refrigerant cooling pipe forming the bypass pipe, the plate being joined between the refrigerant cooling pipe and a controller of the plurality of controllers, wherein in each of the plurality of refrigerant coolers, a region of a first contact portion between the refrigerant cooling pipe and the plate is smaller than a region of a second contact portion between the controller and the plate, and a corresponding region corresponding to the region of the first contact portion on a back surface of the plate falls inside a range of the region of the second contact portion.

2. The refrigeration cycle device of claim 1, wherein in each of the plurality of refrigerant coolers, an area of the region of the first contact portion between the refrigerant cooling pipe and the plate has a size that corresponds to an amount of heat generated from corresponding one of the plurality of controllers.

3. The refrigeration cycle device of claim 1, further comprising a first opening degree control device configured to perform a control of increasing an opening degree of the second expansion device in a case where a condition is satisfied in which, of temperatures of the plurality of controllers, a highest temperature is equal to or above a predetermined temperature and a lowest temperature is equal to or above a predetermined temperature.

4. The refrigeration cycle device of claim 3, further comprising an output suppressing unit configured to perform a control of suppressing an output from the controller having the highest temperature in a case where the condition fails to be satisfied in which, of the temperatures of the plurality of controllers, the highest temperature is equal to or above the predetermined temperature and the lowest temperature is equal to or above the predetermined temperature, and a condition is satisfied in which, of the temperatures of the plurality of controllers, the highest temperature is equal to or above the predetermined temperature.

5. A refrigeration cycle device comprising:

a refrigerant circuit including a compressor, a heat-source-side heat exchanger, a first expansion device, and a load-side heat exchanger, refrigerant cycling through the compressor, the heat-source-side heat exchanger, the first expansion device, and the load-side heat exchanger;

a plurality of controllers configured to control the refrigerant circuit;

a bypass pipe branching from a high pressure pipe on a discharge side of the compressor and connected to a low pressure pipe on a suction side of the compressor;

a second expansion device provided to the bypass pipe, and configured to adjust a flow rate of the refrigerant flowing through the bypass pipe; and a plurality of refrigerant coolers provided to the bypass pipe, and configured to cool the plurality of controllers by using the refrigerant the flow rate of which is adjusted by the second expansion device, each of the plurality of refrigerant coolers including a refrigerant cooling pipe and a plate, the refrigerant cooling pipe forming the bypass pipe, the plate being joined between the refrigerant cooling pipe and a controller of the plurality of controllers, the refrigeration cycle device further comprising:

a first opening degree control device configured to perform a control of increasing an opening degree of the second expansion device in a case where a condition is satisfied in which, of temperatures of the plurality of controllers, a highest temperature is equal to or above a predetermined temperature and a lowest temperature is equal to or above a predetermined temperature;

an output suppressing unit configured to perform a control of suppressing an output from the controller having the highest temperature in a case where the condition fails to be satisfied in which, of the temperatures of the plurality of controllers, the highest temperature is equal to or above the predetermined temperature and the lowest temperature is equal to or above the predetermined temperature, and a condition is satisfied in which, of the temperatures of the plurality of controllers, the highest temperature is equal to or above the predetermined temperature; and an output complementing unit configured to complement an output by a controller other than the controller having the highest temperature of the plurality of controllers in a case where the output from the controller having the highest temperature is suppressed by the output suppressing unit.

6. The refrigeration cycle device of claim 5, wherein in each of the plurality of refrigerant coolers, a region of a first contact portion between the refrigerant cooling pipe and the plate is smaller than a region of a second contact portion between the controller and the plate, and a corresponding region corresponding to the region of the first contact portion on a back surface of the plate falls inside a range of the region of the second contact portion.

7. The refrigeration cycle device of claim 5, wherein in each of the plurality of refrigerant coolers, an area of the region of the first contact portion between the refrigerant cooling pipe and the plate has a size that corresponds to an amount of heat generated from each of the plurality of controllers.

8. A refrigeration cycle device comprising:

a refrigerant circuit including a compressor, a heat-source-side heat exchanger, a first expansion device, and a load-side heat exchanger, refrigerant cycling through the compressor, the heat-source-side heat exchanger, the first expansion device, and the load-side heat exchanger;

a plurality of controllers configured to control the refrigerant circuit;

a bypass pipe branching from a high pressure pipe on a discharge side of the compressor and connected to a low pressure pipe on a suction side of the compressor;

a second expansion device provided to the bypass pipe, and configured to adjust a flow rate of the refrigerant flowing through the bypass pipe; and a plurality of refrigerant coolers provided to the bypass pipe, and configured to cool the plurality of controllers by using the refrigerant the flow rate of which is adjusted by the second expansion device, each of the plurality of refrigerant coolers including a refrigerant cooling pipe and a plate, the refrigerant cooling pipe forming the bypass pipe, the plate being joined between the refrigerant cooling pipe and a controller of the plurality of controllers, the refrigeration cycle device further comprising:

a first opening degree control device configured to perform a control of increasing an opening degree of the second expansion device in a case where a condition is satisfied in which, of temperatures of the plurality of controllers, a highest temperature is equal to or above a predetermined temperature and a lowest temperature is equal to or above a predetermined temperature;

a second opening degree control device configured to perform a control of reducing the opening degree of the second expansion device in a case where a condition is satisfied in which, of the temperatures of the plurality of controllers, the highest temperature is below the predetermined temperature and the lowest temperature is below the predetermined temperature; and a third opening degree control device configured to perform a control of reducing the opening degree of the second expansion device such that an average of the temperatures of the plurality of controllers reaches a target temperature in a case where the condition fails to be satisfied in which, of the temperatures of the plurality of controllers, the highest temperature is below the predetermined temperature and the lowest temperature is below the predetermined temperature, and a condition is satisfied in which the average of the temperatures of the plurality of controllers is below the target temperature.

9. The refrigeration cycle device of claim 8, further comprising a fourth opening degree control device configured to perform a control of increasing the opening degree of the second expansion device such that an average of the temperatures of the plurality of controllers reaches a target temperature in a case where the condition fails to be satisfied in which, of the temperatures of the plurality of controllers, the highest temperature is below the predetermined temperature and the lowest temperature is below the predetermined temperature, and a condition is satisfied in which the average of the temperatures of the plurality of controllers is equal to or above the target temperature.

10. The refrigeration cycle device of claim 8, wherein in each of the plurality of refrigerant coolers, a region of a first contact portion between the refrigerant cooling pipe and the plate is smaller than a region of a second contact portion between the controller and the plate, and a corresponding region corresponding to the region of the first contact portion on a back surface of the plate falls inside a range of the region of the second contact portion.

11. The refrigeration cycle device of claim 8, wherein in each of the plurality of refrigerant coolers, an area of the region of the first contact portion between the refrigerant cooling pipe and the plate has a size that corresponds to an amount of heat generated from each of the plurality of controllers.

12. The refrigeration cycle device of claim 8, further comprising an output suppressing unit configured to perform a control of suppressing an output from the controller having the highest temperature in a case where the condition fails to be satisfied in which, of the temperatures of the plurality of controllers, the highest temperature is equal to or above the predetermined temperature and the lowest temperature is equal to or above the predetermined temperature, and a condition is satisfied in which, of the temperatures of the plurality of controllers, the highest temperature is equal to or above the predetermined temperature.

* * * * *